United States Patent [19]

Eian

[11] 4,326,514

[45] Apr. 27, 1982

[54] CARTRIDGE RESPIRATOR WITH SERVICE LIFE INDICATOR

[75] Inventor: Gilbert L. Eian, White Bear Lake, Minn.

[73] Assignee: Minnesota Mining and Manufacturing Company, St. Paul, Minn.

[21] Appl. No.: 161,441

[22] Filed: Jun. 20, 1980

[51] Int. Cl.[3] ..... A62B 7/10

[52] U.S. Cl. ..... 128/202.22; 73/23; 73/38; 55/DIG. 33; 55/DIG. 35; 55/DIG. 34

[58] Field of Search ..... 128/202.22; 73/23, 38; 55/DIG. 33, DIG. 35, DIG. 34

[56] References Cited

U.S. PATENT DOCUMENTS 1,537,519 5/1925 Yablick ..... 55/DIG. 33
4,155,358 5/1979 McAllister et al. ..... 128/202.22
4,265,635 5/1981 Kring ..... 23/232 R
4,269,804 5/1981 Kring ..... 422/86

FOREIGN PATENT DOCUMENTS 2758603 7/1978 Fed. Rep. of Germany ..... 128/202.22

*Primary Examiner*—Robert W. Michell
*Assistant Examiner*—Nancy A. B. Swisher
*Attorney, Agent, or Firm*—Cruzan Alexander; Donald M. Sell; Lorraine R. Sherman

[57] ABSTRACT

A visually observable means for indicating end of service life of hazardous vapor/gas respirator cartridges or canisters is disclosed. A colorimetric indicator in sheet form is positioned along the inner transparent sidewall of the respirator cartridge or canister.

5 Claims, 2 Drawing Figures

CARTRIDGE RESPIRATOR WITH SERVICE LIFE INDICATOR

TECHNICAL FIELD

This invention relates to improvements in respirators and particularly to respirators containing means for indicating the end of the service life of respirator cartridges for use in atmospheres containing hazardous vapors and/or gases.

BACKGROUND ART

There is increasing interest by government agencies and the general public in protecting individuals against the harmful effects of toxic materials. Respirators of the type employing filter cartridges or canisters are commonly used for protection against respiratory hazards which include toxic vapors and gases. The respirator or only the cartridge is replaced when the end of service life indicator or device incorporated therein indicates insufficient adsorbent capacity remaining in the cartridge to justify its further or additional use.

Monitoring of personal exposure to hazardous materials is the subject of a number of studies of which the following are examples: Natusch, Sewell and Tanner, "Determination of $H_2S$ in Air—An Assessment of Impregnated Paper Tape Methods", *Analytical Chemistry, volume* 46, page 3 (1974); Schnakenberg, "A Passive Personal Sampler for Nitrogen Dioxide", *Bureau of Mines Technical Progress Report* 95 (1976); Ray, Carroll and Armstrong, "Evaluation of Small Color-Changing Carbon Monoxide Dosimeters", *Bureau of Mines Rep. Invest.* (1975); Palmer; "Personal Samplers for CO, NO and $NO_2$ in Air", *Bureau of Mines Report OFR* 92-77 (1977) and Nichols, "Reactive Tapes for Automatic Environmental Analysis, Personal Vapor Monitoring Badges for Industrial Workers", *National Science Foundation Report NSF/RA*-780039 (1978).

Colorimetric end of service life indicators are known in the art. U.S. Pat. No. 4,154,586 (and related German and British Pat. Nos. 2,758,603 and 1,554,542, respectively) provide a visual means for indicating when vapor/gas cartridges have exhausted their capacity to provide respiratory protection at or below a hazardous concentration level. The indicator material comprises a catalytic agent for enhancing activation and reaction of the indicator agent.

U.S. Pat. No. 1,537,519 discloses a ribbed window-type or a transparent canister wall respirator wherein the viewable absorbent is impregnated with an indicator. The patentee also discloses use of an indicator test strip (such as litmus paper) but only with the window-type canister. The patentee states that when use of his respirator is interrupted, the indicator may resume the color or appearance of the unspent indicator.

Another window-type canister or cartridge with color changing indicator means incorporated therein is disclosed in U.S. Pat. No. 3,966,440.

U.S. Pat. No. 4,155,358 discloses a valveless chemical cartridge respirator for vinyl chloride monomer comprising a colorimetric end of service life indicator disposed across the path of air intake at the entrance of the cartridge.

U.S. Pat. No. 4,146,887 discloses a gas or vapor sensing alarm device in an air purifying respirator for warning the wearer of hazardous levels of gases or vapors penetrating through the respirator cartridge.

These prior art end of service life indicators generally utilized granular colorimetric indicator particles or other probes located in the sorbent bed. In contrast to the prior art where indicator reliability may be reduced due to its incorporation in a localized pocket or in a window in the sorbent bed, the present invention utilizes an indicator means which reveals the remaining capacity of the entire sorbent bed rather than the condition of a small volume near the probe or window.

In addition, the colorimetric indicators useful in the present invention undergo irreversible color changes when subjected to gases to be detected.

SUMMARY OF THE INVENTION

The present invention relates to a gas/vapor sorbent-containing cartridge or canister respirator containing a strip of colorimetric indicator fixed along a substantial portion of the inner transparent sidewall of the cartridge or canister such that the indicator substance is oriented towards the sorbent bed. The colorimetric indicator may be a flat, sheet-like, self-supporting structure, porous throughout, or it may be coated onto a transparent substrate since the indicator substance is visually examined from the side oriented away from the sorbent bed. Vapors drawn into the sorbent bed react with the indicator substance causing a color change which corresponds to the exhaustion of capacity of the sorbent bed. An irregular linear boundary forms between reacted and unreacted areas of the indicator substance. This "leading edge" correlates with the channel patterns between adsorbent particles as the sorbent bed removes the hazardous gases or vapors passing through it. As use continues, this boundary moves in the direction of air flow from the front of the cartridge towards the back and the channel patterns of the reacted areas broaden and coalesce, indicating the areas of the sorbent bed which have been exposed to the hazardous vapors. The unreacted areas of the colorimetric indicator correspond to the portion of the sorbent bed which has not been exposed to the subject vapors and still has adsorptive capacity. The position of the boundary in relation to the depth of the sorbent bed relates directly to the unused capacity of the respirator. It is important that the boundary on the colorimetric indicator indicates respirator failure before the "breakthrough" point of the hazardous gas or vapor.

To provide a margin of safety, it is preferred that penetration of the boundary to about 4/5 of the total bed depth be taken to indicate imminent failure of the respirator.

The present invention simplifies the determination of the colorimetric indicator end point in cartridge or canister respirators. The color change appears as a distinct boundary which moves in a linear dimension rather than depending merely on a difference in color or color intensity. This distinct boundary allows for apprising the condition of the sorbent bed throughout the entire perimeter of the cartridge or canister as well as throughout its depth. The capacity of the respirator is not reduced as occurs in devices which require incorporation of the indicator material in a localized pocket. Inspection of the colorimetric indicator reveals the remaining capacity of the sorbent bed rather than the condition of a small volume near the probe. The present invention allows for reuse of cartridge or canister respirators having remaining protective capacity. Migration of vapors from exposed to unexposed portions of the sorbent bed between uses is visually detectable as a new and less irregular boundary and the remaining capacity of the respirator cartridge or canister is therefore apparent. In the present invention the colorimetric indicator is located where leakage of hazardous gas is most likely to occur, i.e., against the sidewall of the cartridge or canister, providing a further safeguard for the respirator wearer.

The present invention includes respirators having shells of different designs. They may be of a disposable-type or they may have replaceable canisters or cartridges. In all cases the canister or cartridge sidewall is transparent so that the colorimetric indicator is viewable therethrough.

BRIEF DESCRIPTION OF THE DRAWINGS

In the accompanying drawing which illustrates the invention.

DETAILED DESCRIPTION OF THE INVENTION

The present invention relates to a respirator having a shell within which is supported a gas/vapor sorbent bed for removal of toxic airborne material from the atmosphere. The respirator contains a cartridge or canister having a transparent sidewall with a colorimetric indicator in strip form positioned along a substantial portion of its inner transparent sidewall such that the colorimetric indicator substance is oriented towards the sorbent bed. The colorimetric indicator is a self-supporting structure, porous throughout, or it has a transparent backing and is viewable through the entire sidewall of the respirator cartridge. The colorimetric indicator is capable of undergoing an irreversible change in color concomitant with exposure to concentrations of toxic vapors and gases which appears as an irregular linear boundary formed between reacted and unreacted areas of the indicator substance and is effective to indicate remaining capacity of the sorbent bed for said toxic airborne material.

Figure 1:
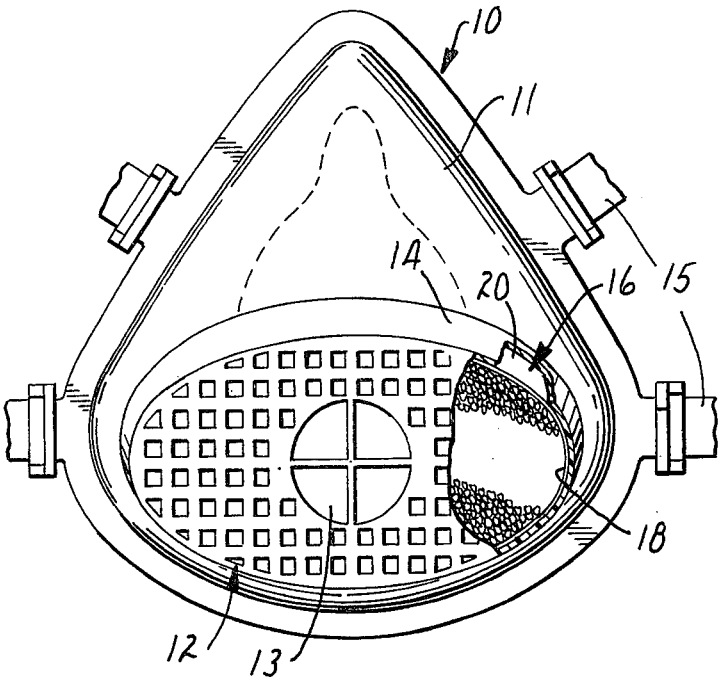
FIG. 1 is a front elevational view of a chemical cartridge respirator with colorimetric indicator sheet material fixed along the inner transparent sidewall, with parts thereof broken away.
Figure 2:
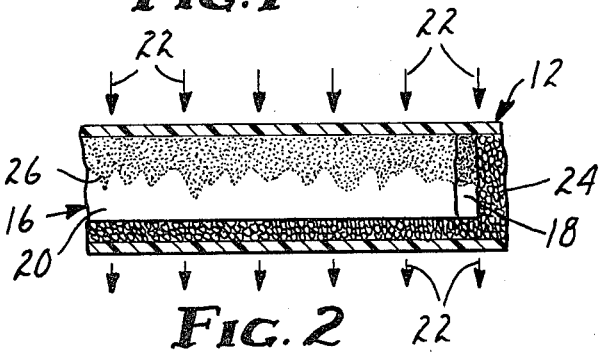
FIG. 2 is an enlarged sectional view of a portion of the respirator cartridge of FIG. 1.

Referring more particularly to FIGS. 1 and 2 of the drawing, 10 denotes a respirator comprising a plastic molded shell 11 having a chemical cartridge 12 with transparent sidewall 14, valve 13, and attachment bands 15. Along the front edge of the inner side of sidewall 14 is positioned colorimetric indicator 16 comprising colorimetric indicator substance 18 coated on transparent backing 20. As indicated by arrows 22 (FIG. 2), the stream of air and gases and/or vapors passes through cartridge 12 when in use, coming into contact with sorbent bed 24 and colorimetric indicator 16. Linear boundary 26, visually observable through transparent sidewall 14 and transparent backing 20 indicates the depth of penetration of the hazardous gas into the cartridge and the remaining adsorbent capacity of the cartridge bed.

Backing 20, coated with colorimetric substance 18, is transparent. Suitable backing materials include polyester film, polycarbonate film, polypropylene film, vinyl films, and cellulosics.

Bench tests to determine indicator life and respirator service life were conducted by passing air containing a known concentration of challenge gas or vapor through the canister or cartridge and continuously analyzing the air exiting from the canister or cartridge with a detector calibrated for the challenge gas in question. Test air was humidified by passage over a vessel containing water at a temperature adequate to produce the desired relative humidity. Acrylonitrile vapors (see EXAMPLES 4, 5, 6, and 7 below) were generated by feeding the liquid by variable speed syringe pump into a solvent vaporization chamber through which test air was swept. Chlorine (see EXAMPLES 1 and 2 below) and sulfur dioxide (see EXAMPLES 1 and 3 below) were bled into the test air from cylinders of pure gas through mass flow controllers. Concentration of challenge gas or vapor in the test stream and exiting from the canister or cartridge was determined with a suitable analytical instrument. Acrylonitrile was determined by a total hydrocarbon analyzer equipped with a flame ionization detector. Sulfur dioxide was determined by gas phase infrared spectrometry. Chlorine was determined with an oxidant monitor using a microcoulomb sensor.

The invention is further illustrated by the following examples. As mentioned above, to provide a margin of safety, penetration of the boundary to about 4/5 of the total bed depth is taken to indicate imminent failure of the respirator.

EXAMPLE 1

A slurry of 33 g of 33% alumina (Alcoa H-151, aluminum oxide, surface area >350 $m^2/g$) in water, 67 g of 33% kaolin (clay) in 10% ethanol, 500 mg indophenol sodium salt, 200 mg lithium hydroxide and 2 g of 9% polyvinyl alcohol (Elvanol 71-30, DuPont, medium molecular weight, fully hydrolyzed) was coated onto 50μ polyester film base backing at 100μ thickness wet. After air drying the sheet was cut into strips 2.54 cm wide; one such strip was laid along the inner sidewall, touching the front edge, of a clear plastic cartridge 3.2 cm deep and fixed in position with adhesive tape. The cartridge was loaded with acid gas sorbent. Air containing 500 ppm sulfur dioxide at 50% relative humidity was passed through the cartridge at a flow rate of 64 liters per minute as prescribed in the standard National Institute of Occupational Safety and Health (NIOSH) service life test. The indicator changed color from dark blue to white on exposure to sulfur dioxide; the depth of penetration into the sorbent bed (boundary line on indicator sheet material) at various times is given in TABLE 1.

TABLE 1

| Exposure Time | Boundary Penetration Minimum | Boundary Penetration Maximum |
|---|---|---|
| 16 min. | .32 cm | 1.3 cm |
| 44 min. | 1.3 | 2.5 |
| 60 min. | 1.9 | 2.5+ |
| 72 min. | 2.5+ | 2.5+ |

After 72 minutes exposure, the entire strip of indicator had changed to white and sulfur dioxide in the air exiting from the respirator had reached 5 ppm, indicating respirator failure.

A similar response was observed when chlorine was substituted for sulfur dioxide as the challenge gas. Chlorine vapors, however, penetrated the sorbent bed more slowly and the service life was longer.

EXAMPLE 2

Two formulations were separately prepared by mixing 260 g toluene, 50 g silica gel (Syloid 244, Davison Chemical, surface area >300 $m^2/g$), 20 g polyvinyl butyral (PVB) (Butvar B-76, Monsanto, molecular weight 45,000 to 50,000 butyral content 88%) and 0.525 g benzoyl leuco methylene blue (Formulation A); and 150 g toluene, 150 g titanium dioxide and 20 g PVB (Formulation B). 10 g of Formulation A and 0.45 g of Formulation B were mixed to produce a homogeneous suspension which was coated on 50μ polyester film base at 100μ wet thickness. A 2.54 cm strip of the dried coated film was attached inside a clear plastic cartridge as in EXAMPLE 1 and the cartridge was filled with acid gas sorbent. The cartridge was challenged with 500 ppm chlorine in air at 50% relative humidity flowing at 64 lpm. The exposed areas of the indicator changed from white to blue as chlorine penetrated the sorbent bed.

EXAMPLE 3

33 g attagel (attapulgite clay) was added to 200 g water, 333 mg sodium salt of indophenol and 1:5 g sodium hydroxide. The mixture was dispersed in a ½ liter jar with 300 g of 1 cm balls by ball milling for 1 hour. The dispersion, uniformly blue in color, was coated on 50μ polyester backing which had been primed using a high voltage corona so that the backing was water wettable. The film was coated 100μ wet and dried to a coating weight of 25 $g/m^2$. The drying was effected by a 14 amp hot air heat gun.

The indophenol/clay coated indicator film prepared above was cut into strips 2.54 cm wide and a strip fixed to the inner sidewall of a clear plastic cartridge as described in EXAMPLE 1. The cartridge was loaded with commercial FCA Whetlerite (Pittsburgh Activated Carbon, division of Calgon Corp., subsidiary of Merck and Co., Inc.). Air containing 500 ppm sulfur dioxide, 50% relative humidity at 25° C., was passed through the cartridge at a flow rate of 64 lpm. Effluent air was analyzed for sulfur dioxide content and the condition of the indicator, as the indicator color changed from dark blue to white, was noted at several times during the service life test. Data is given in TABLE 2.

TABLE 2

| Time | Penetration of Boundary on Indicator Minimum | Maximum |
|---|---|---|
| 5 min. | 0 | .95 cm |
| 16 min. | 1.3 cm | 2.22 cm |
| 32 min. | 1.3 cm | 2.5+ cm |
| 44 min. | 2.2 cm | 2.5+ cm |
| 74 min. | 2.5+ cm | 2.5+ cm (indicator failure) |

After 80 minutes exposure to the challenge airstream, the respirator failed with the concentration of sulfur dioxide in the effluent air reaching 5 ppm.

EXAMPLE 4

A coating formulation was prepared from 60 g 33% alumina (Alcoa H-151) in water, 3.3 g bentonite clay, 1.25 g potassium permanganate and 150 g water and coated on 50μ polyester film base to provide a dry coating weight of 13 $g/m^2$. Strips of the film cut to 2.54 cm widths were fitted in clear plastic cartridges as in EXAMPLE 1 after which the cartridges were loaded with granular activated carbon. The cartridges were challenged with air at 50% relative humidity containing acrylonitrile (AN) at various concentrations and flow rates as given in the table below. The indicator changed from purple to light tan when exposed to acrylonitrile vapor. The indicator endpoint was reached when no purple color remained on the indicator. Respirator life refers to time elapsed until 4 ppm AN was present in air exiting from the respirator. The data are given in TABLE 3.

TABLE 3

Acrylonitrile Indicator Life and Respirator Life Data (Clay-Based Coating)

| AN Concentration | Air Flow | Indicator Life | Respirator Life |
|---|---|---|---|
| 1,000 ppm | 64 lpm | 65 min. | 82 min. |
| 1,000 ppm | 32 lpm | 173 min. | 185 min. |
| 1,000 ppm | 16 lpm | 270 min. | 350 min. |
| 235 ppm | 64 lpm | 230 min. | 275 min. |

The data indicated that, as expected, changes in the concentration of AN and changes in its flow rate caused corresponding, but inverse, changes in indicator life and respirator life. In all cases the indicator failed before the respirator.

The bentonite clay-containing colorimetric indicator sheet material of this example and the attapulgite clay-containing composition of EXAMPLE 3 are the subject of assignee's copending application, Ser. No. 161,442, filed June 20, 1980.

EXAMPLE 5

Vinyl chloride respirators with granular indicator material comprised of potassium permanganate deposited on alumina, prepared and constructed as described in U.S. Pat. No. 4,155,358, were challenged with acrylonitrile in air at 50% relative humidity at concentration and air flow conditions noted below. Indicator life and respirator service life were determined. In all cases, the indicator life was too short compared to respirator service life (5 ppm penetration) to be useful and the data are set forth in TABLE 4.

TABLE 4

Acrylonitrile Indicator Life and Respirator Life

| AN Concentration | Air Flow | Indicator Life | Respirator Life |
|---|---|---|---|
| 1,000 ppm | 64 lpm | <0.5 min. | 50 min. |
| 235 ppm | 64 lpm | 2.0 min. | 275 min. |
| 50 ppm | 64 lpm | 5.0 min. | >200 min. |
| 10 ppm | 64 lpm | 15.0 min. | >200 min. |
| 235 ppm | 16 lpm | 10.0 min. | >200 min. |

The data indicate that this prior art vinyl chloride respirator was not suitable for use with AN due to the extremely short indicator life.

EXAMPLE 6

Three samples made as described in EXAMPLE 4 were exposed to 1,000 ppm AN in air at 50% relative humidity flowing at 64 lpm for different lengths of time. One sample was exposed for 5 minutes, another for 10 minutes and another for 20 minutes. These partially used respirators were set aside in closed polyethylene bags except for brief test periods after 1, 3, 6 and 14 days. During these tests, air at 50% relative humidity but without added AN vapor, was passed through the cartridges at 64 lpm. The effluent air was analyzed for AN and indicator condition (depth of boundary penetration) was noted. Results are given in TABLE 5.

TABLE 5

Acrylonitrile Desorption Data

| Initial Exposure Time | Time Elapsed After Initial Exposure | Concentration of AN in Effluent Air | Penetration of Boundary on Indicator Strip Minimum | Penetration of Boundary on Indicator Strip Maximum |
|---|---|---|---|---|
| 5 min. | 0 day | 0 ppm | 0.16 cm | 1.11 cm |
| 5 min. | 1 day | 0 ppm | 1.3 cm | 1.4 cm |
| 5 min. | 3 day | 0 ppm | 2.2 cm | 2.5 cm |
| 5 min. | 6 day | 0 ppm | 2.5+ cm | 2.5+ cm |
| 5 min. | 16 day | 0.6 ppm | 2.5+ cm | 2.5+ cm |
| 10 min. | 0 day | 0 ppm | 0.64 cm | 1.9 cm |
| 10 min. | 1 day | 0 ppm | 1.9 cm | 2.5 cm |
| 10 min. | 3 day | 0 ppm | 2.5+ cm | 2.5+ cm |
| 10 min. | 6 day | 0.4 ppm | 2.5+ cm | 2.5+ cm |
| 10 min. | 14 day | 6.2 ppm | 2.5+ cm | 2.5+ cm |
| 20 min. | 0 day | 0 ppm | 0.64 cm | 1.9 cm |
| 20 min. | 1 day | 1.4 ppm | 2.5+ cm | 2.5+ cm |
| 20 min. | 3 day | 1.4 ppm | 2.5+ cm | 2.5+ cm |
| 20 min. | 6 day | 10 ppm | 2.5+ cm | 2.5+ cm |
| 20 min. | 14 day | 40 ppm | 2.5+ cm | 2.5+ cm |

The data in the third column show that migration of AN occurs with time even under static air conditions. Longer initial exposure times and longer lapse times after initial exposure contributed to desorption of acrylonitrile from the cartridge sorbent bed and subsequent failure of the respirator. In all cases the indicator warned of respirator failure before it occurred.

EXAMPLE 7

The following coating formulations were prepared.

| | | | | |
|---|---|---|---|---|
| A. | 80 | gms | 3% | bentonite clay in water |
| | 40 | gms | 36% | alumina (Alcoa H-151) slush in water |
| | 0.84 | gms | | potassium permanganate |
| B. | 80 | gms | 3% | bentonite clay in water |
| | 40 | gms | 36% | alumina (Alcoa H-151) slush in water |
| | 0.42 | gms | | potassium permanganate |
| C. | 80 | gms | 3% | bentonite clay in water |
| | 26 | gms | 36% | alumina (Alcoa H-151) slush in water |
| | 0.55 | gms | | potassium permanganate |

Each sample was coated on 50μ polyester film base at an orifice of 100μ. Indicator strips were mounted in cartridges as described in EXAMPLE 4 and challenged with air containing 10 ppm AN and 50% relative humidity at 64 lpm flow. Indicator response in terms of color change, depth of boundary penetration after 20 minutes exposure and boundary penetration after two days aging of the partially used cartridge was identical for all three indicator samples.

Two other indicators were made by coating Formulation A at 50μ orifice and 250μ orifice. Response of these indicators in loaded cartridges to a challenge of 10 ppm AN in air at 64 lpm after 20 minutes was identical.

The data indicate that coating weight, permanganate loading and alumina/bentonite ratios can be varied to a certain extent without serious effect on indicator response. Varying coating thickness by a factor of 5, change in permanganate loading by a factor of 2, and change in alumina/bentonite ratio from 6/1 to 4/1, gave no change in results indicating that there was latitude in coating composition.

What is claimed is:

1. A respirator for protection against toxic airborne material in the atmosphere comprising a shell, a canister or cartridge having a transparent sidewall within which is supported a gas/vapor sorbent bed, and a colorimetric indicator comprising a flat, sheet-like self-supporting structure of said chlorimetric indicator coated onto a transparent substrate in a dry coating weight in the range of 13 to 62 g/m$^2$ positioned along and parallel to a substantial portion of the inner transparent sidewall of said respirator canister or cartridge such that the colorimetric indicator substance is oriented towards the sorbent bed, said colorimetric indicator capable of undergoing an irreversible change in color concomitant with exposure to concentrations of toxic vapors and gases which appears as an irregular linear boundary between reacted and unreacted areas of said indicator substance which is viewable through the sidewall of said respirator canister or cartridge to visually indicate remaining capacity of the sorbent bed for said toxic airborne material.

2. The respirator according to claim 1 wherein said colorimetric indicator comprises a clay mineral binder.

3. The respirator according to claim 1 wherein said colorimetric indicator substance comprises an indicator dye selected from potassium permanganate, sodium salt of indophenol, and benzoyl leuco methylene blue.

4. A respirator according to claim 1 wherein said canister or cartridge is replaceable.

5. The respirator according to claim 1 wherein the transparent backing of said colorimetric indicator is a flexible polyester film.

* * * * *

UNITED STATES PATENT AND TRADEMARK OFFICE

CERTIFICATE OF CORRECTION

PATENT NO. : 4,326,514

DATED : April 27, 1982

INVENTOR(S) : Gilbert L. Eian

It is certified that error appears in the above—identified patent and that said Letters Patent is hereby corrected as shown below:

Column 8, line 25, replace "chlorimetric" with

-- colorimetric --.

Signed and Sealed this

*Thirty-first* Day of *August 1982*

[SEAL]

*Attest:*

GERALD J. MOSSINGHOFF

*Attesting Officer*

*Commissioner of Patents and Trademarks*